US012709832B2

(12) United States Patent
Lei et al.

(10) Patent No.: US 12,709,832 B2
(45) Date of Patent: Aug. 18, 2026

(54) DETERGENT COMPARTMENT AND LAUNDRY PROCESSING DEVICE

(71) Applicants: QINGDAO HAIER WASHING ELECTRIC APPLIANCE CO., LTD, Shandong (CN); HAIER SMART HOME CO., LTD., Shandong (CN)

(72) Inventors: Chengshan Lei, Shandong (CN); Meijing Wang, Shandong (CN); Yang Li, Shandong (CN); Yunpeng Sun, Shandong (CN); Chunfeng Zhang, Shandong (CN)

(73) Assignees: QINGDAO HAIER WASHING ELECTRIC APPLIANCE CO., LTD, Shandong (CN); HAIER SMART HOME CO., LTD., Shandong (CN)

( * ) Notice: Subject to any disclaimer, the term of this patent is extended or adjusted under 35 U.S.C. 154(b) by 142 days.

(21) Appl. No.: 18/722,462

(22) PCT Filed: Dec. 28, 2022

(86) PCT No.: PCT/CN2022/142612
§ 371 (c)(1),
(2) Date: Jun. 20, 2024

(87) PCT Pub. No.: WO2023/125603
PCT Pub. Date: Jul. 6, 2023

(65) Prior Publication Data

US 2025/0066982 A1 Feb. 27, 2025

(30) Foreign Application Priority Data

Dec. 28, 2021 (CN) ..... 202111621416.1

(51) Int. Cl.
*D06F 39/08* (2006.01)
*D06F 37/12* (2006.01)
*D06F 39/02* (2006.01)

(52) U.S. Cl.
CPC ..... *D06F 39/088* (2013.01); *D06F 37/12* (2013.01); *D06F 39/022* (2013.01); *D06F 39/028* (2013.01)

(58) Field of Classification Search
CPC ..... D06F 39/088; D06F 37/12; D06F 39/022; D06F 39/028
USPC ..... 68/17 R
See application file for complete search history.

(56) References Cited

FOREIGN PATENT DOCUMENTS

| | | | |
|---|---|---|---|
| CN | 104500453 | A | 4/2015 |
| CN | 104762792 | A | 7/2015 |
| CN | 204570288 | U | 8/2015 |
| CN | 204570289 | U | 8/2015 |

(Continued)

OTHER PUBLICATIONS

CN204570288U—machine translation (Year: 2015).*
International Search Report issued in International Application No. PCT/CN2022/142612 on Mar. 16, 2023.

*Primary Examiner* — Tinsae B Ayalew
(74) *Attorney, Agent, or Firm* — ArentFox Schiff LLP; Joseph M. Maraia

(57) ABSTRACT

Provided are a detergent compartment and a laundry processing device. The detergent compartment includes a first receiving cavity. The top of the first receiving cavity is provided with a water inlet. A water inlet assembly is disposed at the water inlet and configured to pressurize a water flow passing through the water inlet and direct the water flow onto the sidewall of the first receiving cavity.

16 Claims, 10 Drawing Sheets

(56) References Cited

FOREIGN PATENT DOCUMENTS

| | | | |
|---|---|---|---|
| CN | 214694745 | U | 11/2021 |
| JP | H05137888 | A | 6/1993 |

* cited by examiner

DETERGENT COMPARTMENT AND LAUNDRY PROCESSING DEVICE

The present disclosure claims priority to Chinese Patent Application No. 202111621416.1 filed with the China National Intellectual Property Administration (CNIPA) on Dec. 28, 2021, the disclosure of which is incorporated herein by reference in its entirety.

TECHNICAL FIELD

The present application relates to the field of laundry processing devices, for example, a detergent compartment and a laundry processing device.

BACKGROUND

A laundry processing device is a device for washing or drying laundry. A laundry processing device may be a washing machine, a laundry dryer, or a washer-dryer combo. Laundry processing devices are divided into front-loading devices and top-loading devices. Depending on washing manners, laundry processing devices are divided into vertical-type processing devices having a rotary agitator or drum and horizontal-type processing devices having a rotary drum. In the related art, most typical laundry processing devices having a washing function are drum washing machines and agitator washing machines.

To store detergent for laundry washing, a pull-out detergent compartment is usually disposed on a laundry processing device. In the related art, the rinsing speed of a detergent compartment cannot satisfy the requirement of fast rinsing of detergent at a low water pressure, and detergent adhering to the sidewall of the detergent compartment cannot be removed from the detergent compartment, reducing the utilization rate of the detergent.

SUMMARY

The present application provides a detergent compartment and a laundry processing device to rapidly rinse detergent at a low water pressure and rinse away detergent adhering to the sidewall of the detergent compartment.

In a first aspect, embodiments of the present application provide a detergent compartment. The detergent compartment includes a first receiving cavity. The top of the first receiving cavity is provided with at least one water inlet. A water inlet assembly is disposed at the water inlet and configured to pressurize a water flow passing through the water inlet and direct the water flow onto the sidewall of the first receiving cavity.

In a second aspect, embodiments of the present application provide a laundry processing device. The laundry processing device includes a drum and the preceding detergent compartment.

REFERENCE LIST

Figure 1:
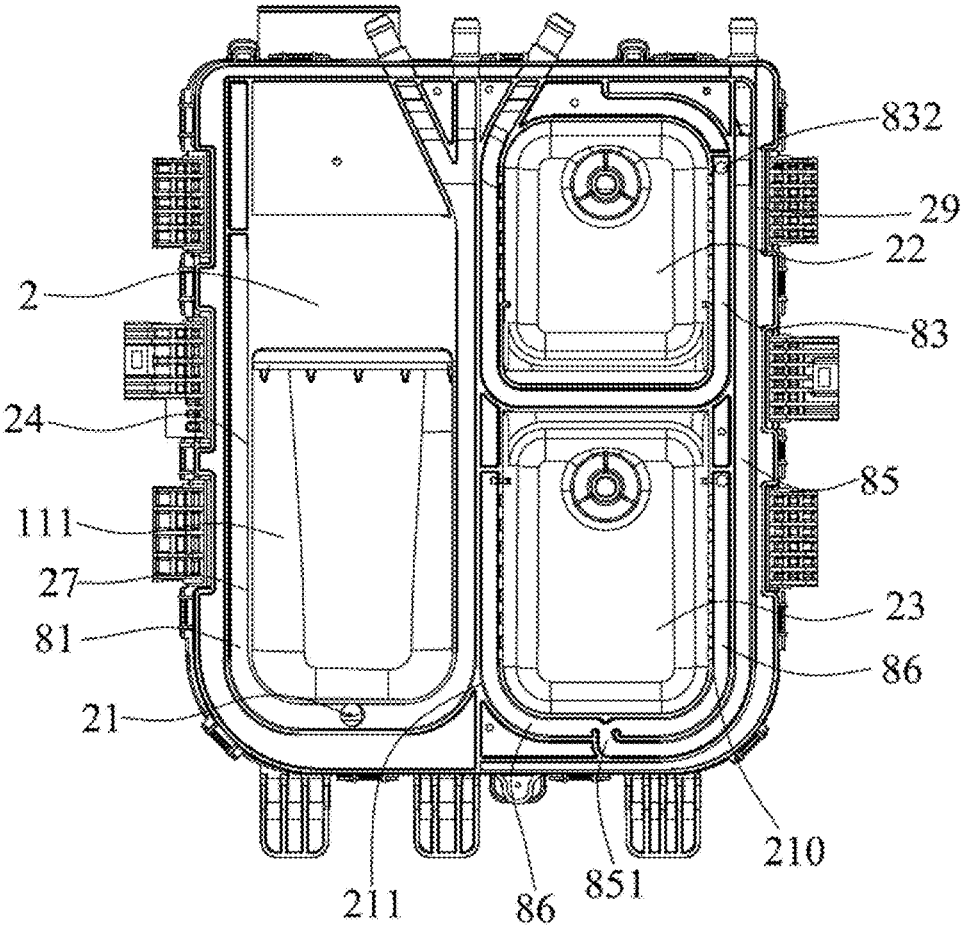
FIG. 1 is a view taken at a first angle to illustrate the structure of a compartment body and a main component according to embodiment one of the present application.

100 table top
101 annular protrusion
1 compartment body
2 main component
3 water inlet assembly
4 siphon cap
7 annular sealing member
11 first cavity
111 first receiving cavity
112 blocking member
12 second cavity
13 drainage cavity
14 engagement block
15 raised rib
21 water inlet
22 second receiving cavity
23 third receiving cavity
24 placement port
25 support member
26 engagement slot
27 first water guide rib
28 third water guide rib
29 fifth water guide rib
210 sixth water guide rib
211 seventh water guide rib
212 water diverter protrusion
31 inlet pipe
32 pressurizing plate
33 arc notch
34 slope
35 water blocking member
301 guide plate
302 guide surface

312 second long flow channel
303 water blocking protrusion
51 first compartment cover member
511 second water guide rib
512 fourth water guide rib
513 water guide rib plate group
52 second compartment cover member
61 sealing body
62 abutment leg part
63 deformation part
81 first flow channel
82 first cooperative flow channel
83 second flow channel
831 first water inlet notch
832 drain hole
84 second cooperative flow channel
85 third flow channel
851 outlet
86 fourth flow channel
861 second water inlet notch
87 third cooperative flow channel
88 fourth cooperative flow channel
91 first inlet pipe
92 second inlet pipe
93 third inlet pipe
94 fourth inlet pipe

DETAILED DESCRIPTION

Embodiments of the present application are described hereinafter in detail in conjunction with the drawings. The embodiments described are part, not all, of the embodiments of the present application. Based on the examples of the present application, all other examples obtained by those skilled in the art without creative work are within the scope of the present application.

In the description of the present application, terms "joined", "connected", and "fixed" are to be understood in a broad sense unless otherwise expressly specified and limited. For example, the term "connected" may refer to "fixedly connected", "detachably connected", or integrated, may refer to "mechanically connected" or "electrically connected", or may refer to "connected directly", "connected indirectly through an intermediary", "connected inside two elements", or an "interaction relation between two elements". For those of ordinary skill in the art, meanings of the preceding terms in the present application may be understood based on situations.

In the present application, unless otherwise expressly specified and limited, when a first feature is described as "on" or "below" a second feature, the first feature and the second feature may be in direct contact or be in contact via another feature between the two features instead of being in direct contact. Moreover, when the first feature is described as "on", "above", or "over" the second feature, the first feature is right on, above, or over the second feature, the first feature is obliquely on, above, or over the second feature, or the first feature is simply at a higher level than the second feature. When the first feature is described as "under", "below", or "underneath" the second feature, the first feature is right under, below, or underneath the second feature, the first feature is obliquely under, below, or underneath the second feature, or the first feature is simply at a lower level than the second feature.

In the related art, the rinsing speed of a detergent compartment cannot satisfy the requirement of fast rinsing of detergent at a low water pressure, and detergent adhering to the sidewall of the detergent compartment cannot be removed from the detergent compartment, reducing the utilization rate of the detergent. To solve this problem, embodiments of the present application provide a detergent compartment and a laundry processing device.

Embodiment One

Figure 2:
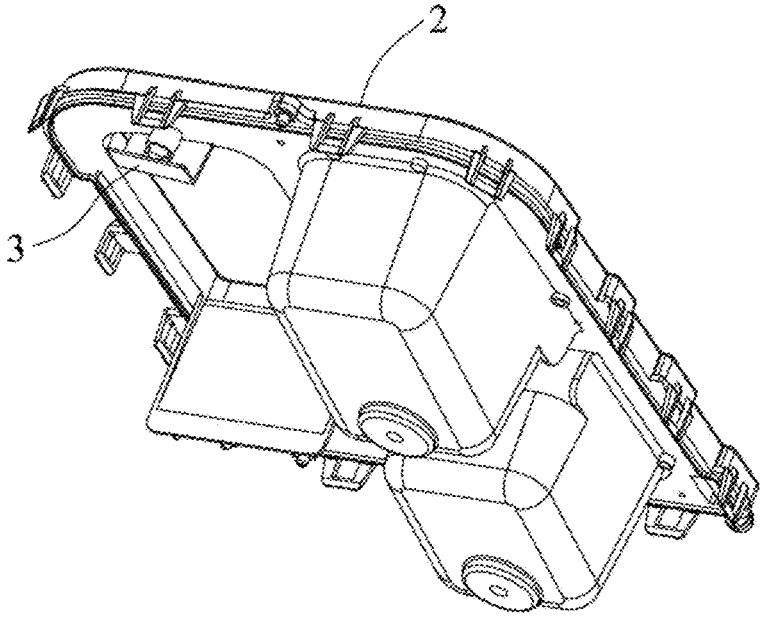
FIG. 2 is a view taken at the first angle to illustrate the structure of the main component according to embodiment one of the present application.

As shown in FIG. 1 and FIG. 2, in this embodiment, the detergent compartment includes a first receiving cavity 111. The top of the first receiving cavity 111 is provided with at least one water inlet 21. A water inlet assembly 3 is disposed at the water inlet 21 and configured to pressurize a water flow passing through the water inlet 21 and direct the water flow onto the sidewall of the first receiving cavity 111. A detergent may be placed in the first receiving cavity 111. The water flow may enter the first receiving cavity 111 through the water inlet 21 at the top of the first receiving cavity 111. The water inlet assembly 3 can pressurize the water flow flowing through the water inlet 21 to ensure that the water outflow pressure in the first receiving cavity 111 can be ensured at a low water pressure and can rapidly rinse away the detergent. Meanwhile, the water inlet assembly 3 can direct the water flow onto the sidewall of the first receiving cavity 111 to make the water flow rinse away the detergent adhering to the sidewall of the first receiving cavity 111, improving the utilization rate of the detergent.

Figure 3:
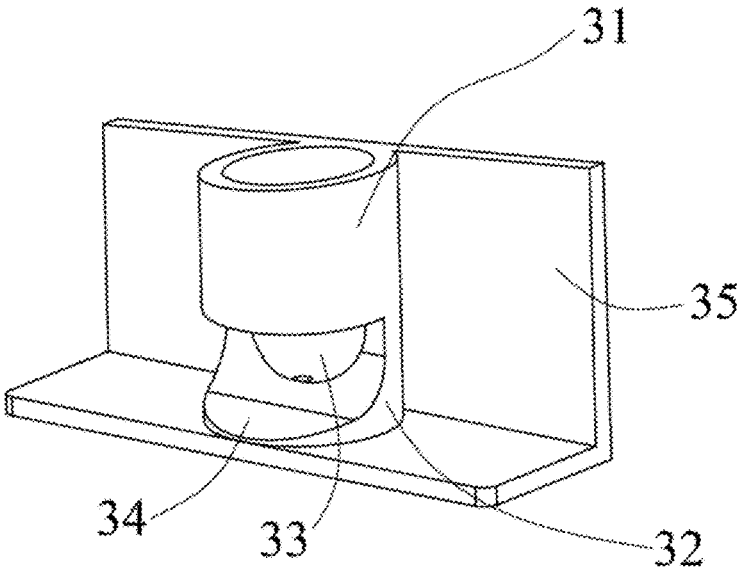
FIG. 3 is a view illustrating the structure of a water inlet assembly according to embodiment one of the present application.

Referring to FIG. 2 and FIG. 3, the water inlet assembly 3 includes an inlet pipe 31. The inlet pipe 31 is disposed in the first receiving cavity 111. A first end of the inlet pipe 31 is connected to the water inlet 21. A pressurizing plate 32 is connected to a second end of the inlet pipe 31. The pressurizing plate 32 is configured to receive the water flow from the inlet pipe 31. The pressurizing plate 32 is inclined towards the bottom of the first receiving cavity 111 and extends towards the sidewall of the first receiving cavity 111. A first long flow channel is formed between the pressurizing plate 32 and the sidewall of the first receiving cavity 111. The water flow from the inlet pipe 31 is directed onto the pressurizing plate 32. The pressurizing plate 32 is inclined downwards and is spaced from the sidewall of the first receiving cavity 111 to form the first long flow channel. The first long flow channel can increase the water inflow pressure. The pressurizing plate 32 can also scatter the water flow to increase the area of the water flow directed onto the sidewall of the first receiving cavity 111, ensuring that the water flow can flow downwards throughout the sidewall of the first receiving cavity 111 and preventing the detergent from being left on the sidewall of the first receiving cavity 111.

In this embodiment, the pressurizing plate 32 is L-shaped, a riser plate of the pressurizing plate 32 is connected to the inlet pipe 31, and an arc notch 33 extending downwards and towards a cross plate of the pressurizing plate 32 is disposed on the riser plate of the pressurizing plate 32, and a slope 34 inclined downwards is disposed on the upper surface of the cross plate of the pressurizing plate 32. The water flow from the inlet pipe 31 is directed onto the arc surface of the arc notch 33 so that the water flow forms a scattering fan, increasing the area of the water flow directed onto the sidewall of the first receiving cavity 111. In this embodiment, the pressurizing plate 32 may be integrally connected to the inlet pipe 31. Such a strong structure can be easily processed.

The inner sidewall of the arc notch 33 is a circular arc. The opening of the arc notch 33 faces the sidewall of the first receiving cavity 111 so that a fan-shaped water flow facing the sidewall of the first receiving cavity 111 is formed to increase the area of the water flow rinsing the sidewall of the first receiving cavity 111.

The water inlet assembly 3 also includes a water blocking member 35. The water blocking member 35 is connected to the pressurizing plate 32. The water blocking member 35 is configured to block the water flow from flowing away from the sidewall of the first receiving cavity 111, thus preventing the water flow from being scattered in a manner that the detergent adhering to the sidewall of the first receiving cavity 111 cannot be well rinsed away.

To facilitate installation of the water blocking member 35 and simplify the structure of the water inlet assembly 3, the water blocking member 35 is an L-shaped plate disposed on the side of the pressurizing plate 32 facing away from the sidewall of the first receiving cavity 111, thus blocking the water flow without affecting outflow of the water flow. A riser plate of the water blocking member 35 is connected to a first end of the pressurizing plate 32. A cross plate of the water blocking member 35 is connected to a second end of the pressurizing plate 32. For example, the riser plate of the water blocking member 35 is connected to the riser plate of the pressurizing plate 32, and the riser plate can extend to the end of the inlet pipe 31 where the inlet pipe 31 is connected to the water inlet 21, increasing the water blocking area. The cross plate of the water blocking member 35 is connected to the lower surface of the cross plate of the pressurizing plate 32 to support the cross plate of the pressurizing plate 32 to a certain degree.

The water blocking member 35 may be integrally connected to the pressurizing plate 32 and the inlet pipe 31 to improve the structural strength of the water inlet assembly 3.

In this embodiment, as shown in FIG. 1, FIG. 4, FIG. 5, and FIG. 6, the detergent compartment also includes a compartment body 1 and a main component 2. The main component 2 is connected to the compartment body 1. The main component 2 and the compartment body 1 form the first receiving cavity 111. The water inlet 21 is disposed on the main component 2.

Figure 4:
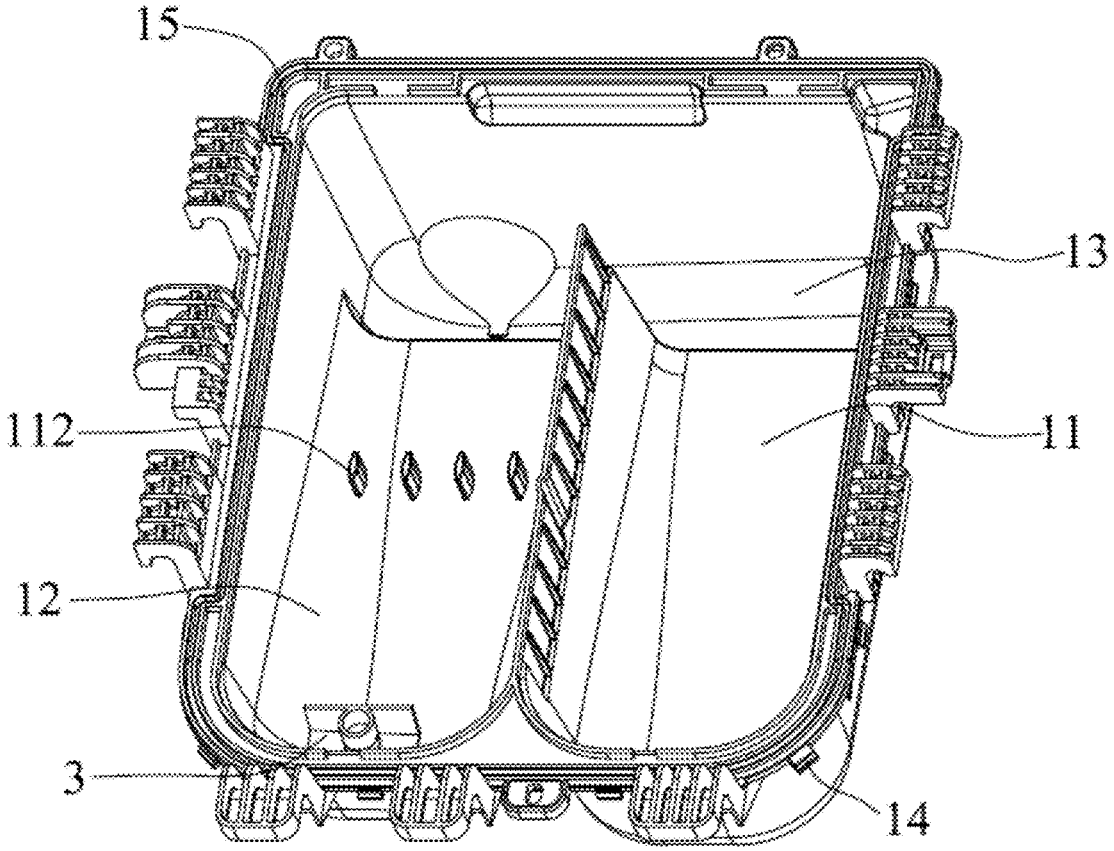
FIG. 4 is a view illustrating the structure of a compartment body according to embodiment one of the present application.

Referring to FIG. 4, the compartment body 1 is concave to form a first cavity 11 and a second cavity 12. The first cavity 11 and the second cavity 12 are disposed side by side in the length direction of the compartment body 1. For example, a partition is disposed in the compartment body 1 to divide the compartment body 1 into the first cavity 11 and the second cavity 12. A drainage cavity 13 is disposed in the width direction of the compartment body 1 and perpendicular to the first cavity 11 and the second cavity 12, and the drainage cavity 13 is connected to the first cavity 11 and the second cavity 12. The drainage cavity 13 is connected to an external drainage pipe to discharge water outwards.

To enhance the strength of the compartment body 1, multiple groups of stiffener plates are disposed on the sidewall of the compartment body 1 in the circumferential direction.

Figure 5:
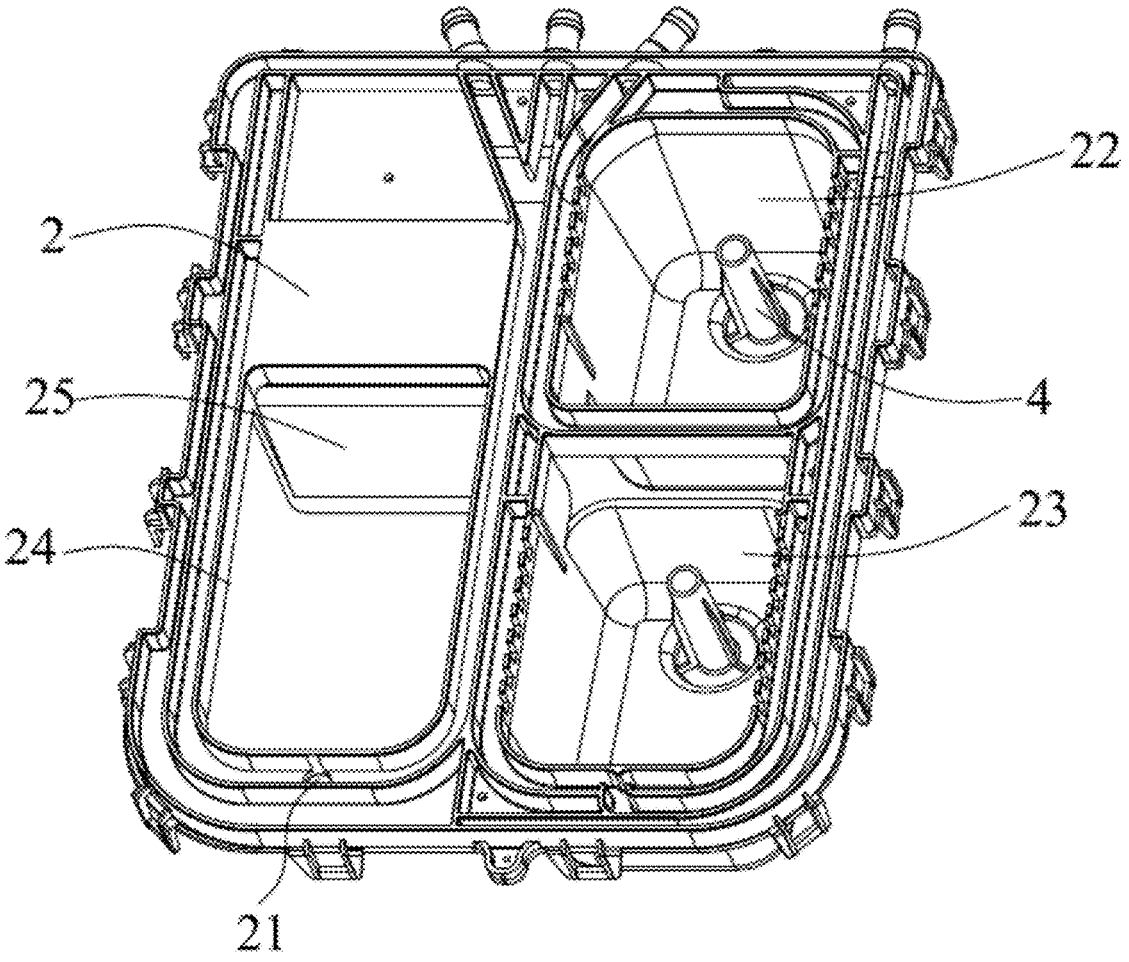
FIG. 5 is a view taken at a second angle to illustrate the structure of the main component according to embodiment one of the present application.

Referring to FIG. 5, the main component 2 has a body support plate that is recessed to form a second receiving cavity 22 and a third receiving cavity 23. The second receiving cavity 22 and the third receiving cavity 23 are disposed side by side in the width direction of the main component 2. A placement port 24 is disposed on the body support plate. The placement port 24 is disposed aside the second receiving cavity 22 and the third receiving cavity 23. The placement port 24 may be, for example, rectangular.

A support member 25 is disposed on one side of the placement port 24. The support member 25 extends downwards from the body support plate. The support member 25 is a support plate. The width of the support member 25 is similar to that of the placement port 24.

Figure 6:
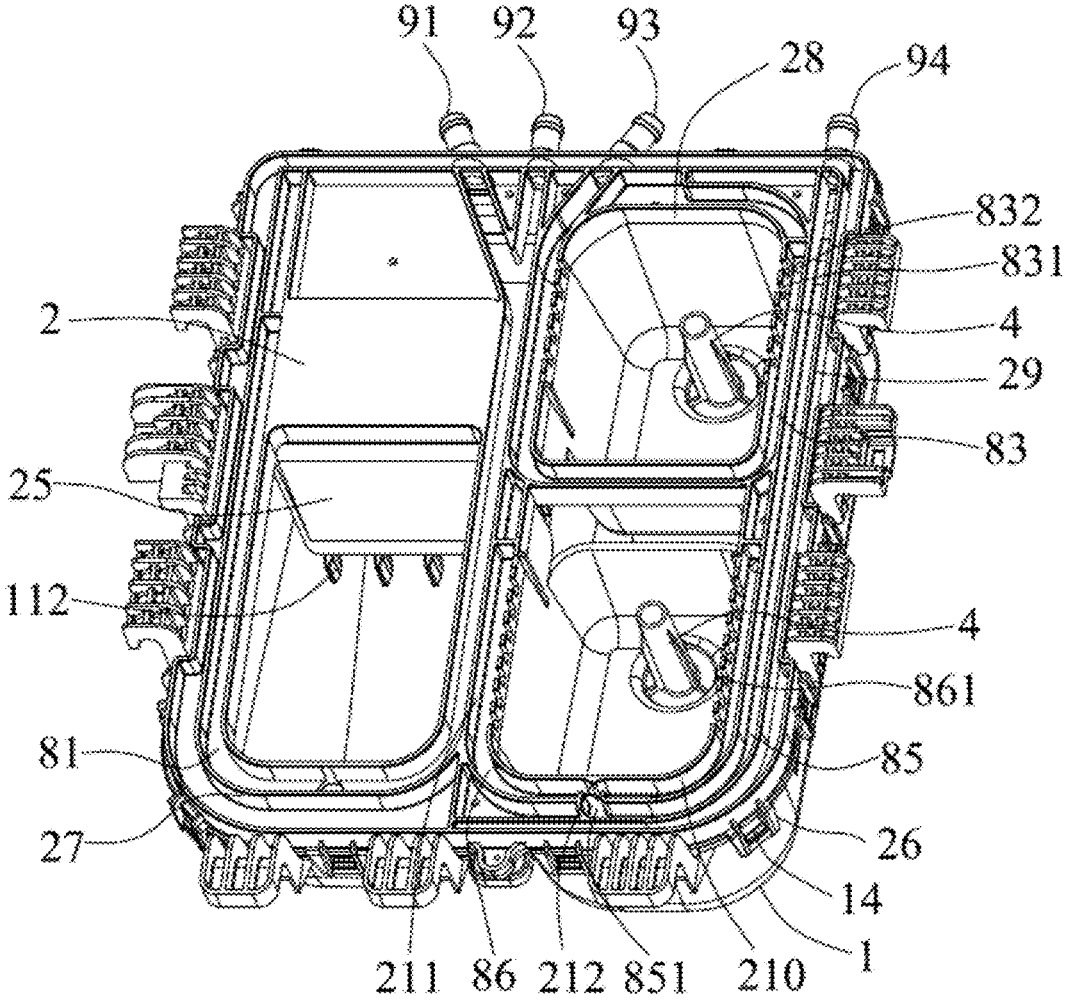
FIG. 6 is a view taken at the second angle to illustrate the structure of the compartment body and the main component according to embodiment one of the present application.
Figure 7:
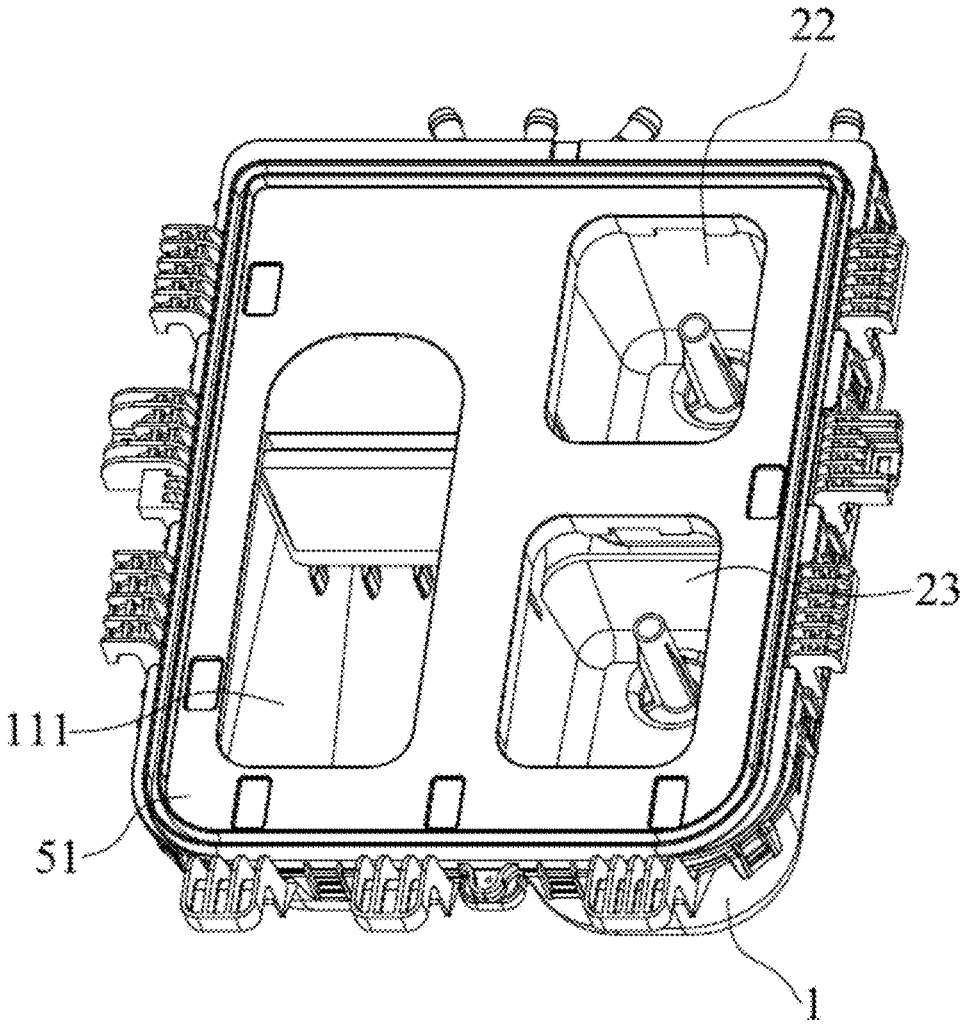
FIG. 7 is a view illustrating the connection structure of a first compartment cover member, the compartment body, and the main component according to embodiment one of the present application.
Figure 8:
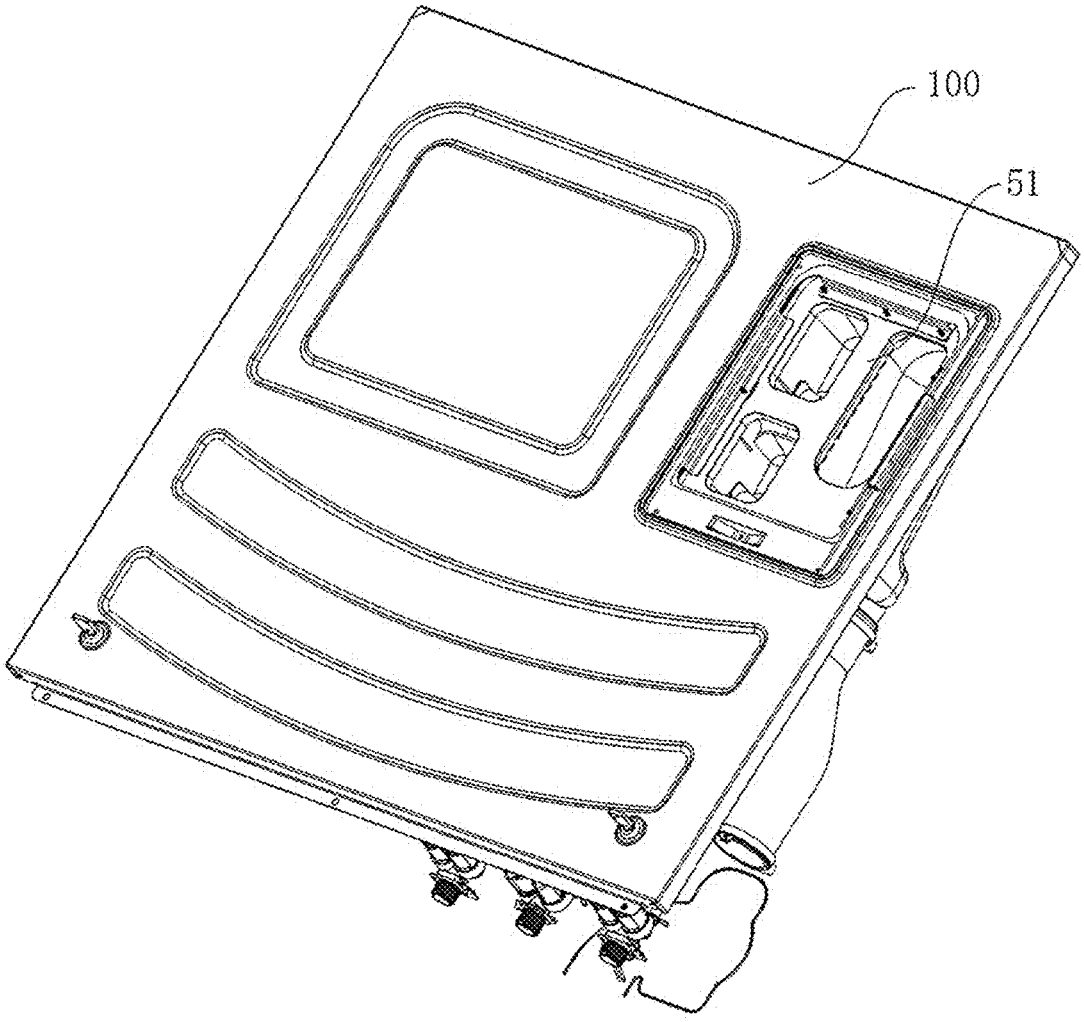
FIG. 8 is a structure view illustrating that a detergent compartment is mounted to a table top according to embodiment one of the present application.
Figure 9:
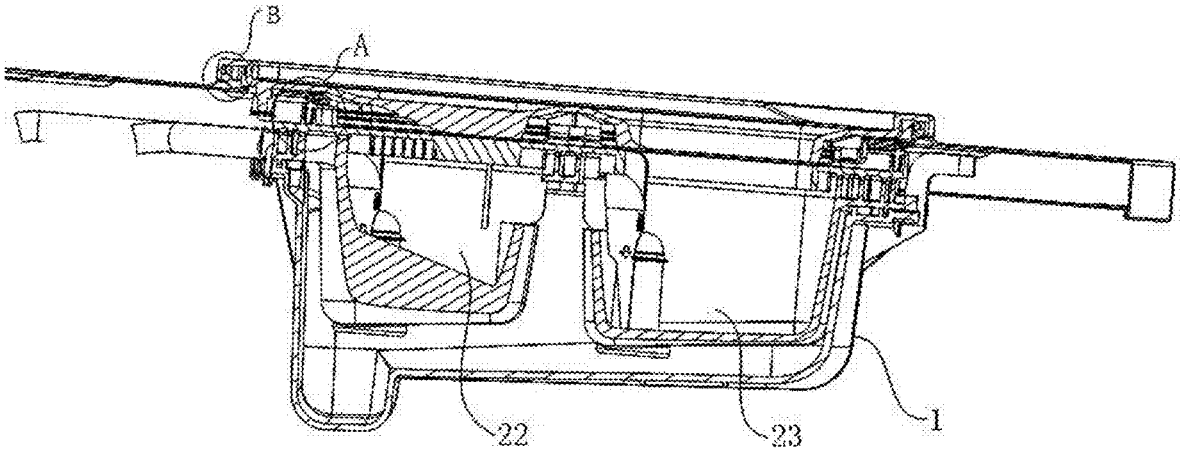
FIG. 9 is a sectional view illustrating that the detergent compartment is mounted to the table top according to embodiment one of the present application.

Referring to FIG. 4, FIG. 5, and FIG. 6, after installation of the compartment body 1 and the main components 2 is completed, the second receiving cavity 22 and the third receiving cavity 23 are located in the first cavity 11. The second receiving cavity 22 and the third receiving cavity 23 are spaced from the first cavity 11. A guide cavity is formed between the second receiving cavity 22 and the first cavity 11 and between the third receiving cavity 23 and the first cavity 11. The guide cavity is connected to the drainage cavity 13.

To enable the diluted laundry detergent in the second receiving cavity 22 and the third receiving cavity 23 to enter the guide cavity and enter the drainage cavity 13, both the second receiving cavity 22 and the third receiving cavity 23 have a siphon cap 4 suitable for a liquid detergent.

In some embodiments, a bleach may be placed in the second receiving cavity 22, and a softener may be placed in the third receiving cavity 23. After water enters the second receiving cavity 22 and the third receiving cavity 23, the bleach in the second receiving cavity 22 and the softener in the third receiving cavity 23 are diluted and sucked into the guide cavity through the siphon cap 4 in each receiving cavity, pass through the guide cavity, flow into the drainage cavity 13 connected to the guide cavity, and then are drained into the drum of a laundry processing device for washing.

The placement port 24 on the body support plate corresponds to the second cavity 12. After the main component 2 is mounted on the compartment body 1, the main component 2 and the second cavity 12 enclose and form the first receiving cavity 111 whose opening is the placement port 24. The first receiving cavity 111 is connected to the drainage cavity 13.

The first receiving cavity 111 has a large size and is disposed aside the second receiving cavity 22 and the third receiving cavity 23. The first receiving cavity 111 is configured to receive a washing powder or a washing liquid. A washing powder is poured into the first receiving cavity 111 through the placement port 24, is diluted by the water flow in the first receiving cavity 111, is directly drained into the drainage cavity 13, passes through the drainage pipe, and reaches the inside of the laundry processing device.

In this embodiment, a gap is disposed between the support member 25 extending downwards from the body support plate and the bottom wall of the first receiving cavity 111, multiple blocking members 112 are disposed in the gap, and guide channels for guiding the water flow in the first receiving cavity 111 into the drainage cavity 13 are formed between the multiple blocking members 112.

The blocking members 112 are blocking plates or blocking blocks. The blocking members 112 can prevent water in the first receiving cavity 111 from rapidly entering the drainage cavity 13, can prevent the detergent in the first receiving cavity 111 from being rapidly washed into the inside of the laundry processing device before the detergent is melted, and can prevent impurities in the detergent poured into the first receiving cavity 111 from entering the laundry processing device.

In this embodiment, the main component 2 is fastened to the compartment body 1. For example, engagement components cooperating with each other are disposed between the main component 2 and the compartment body 1. It is feasible to provide an engagement block 14 on the compartment body 1 and an engagement slot 26 on the main component 2 to connect the main component 2 and the compartment body 1. It is feasible to provide multiple groups of engagement blocks 14 and engagement slots 26 arranged on the main component 2 and the compartment body 1 in the circumferential direction.

To connect the compartment body 1 and the main component 2 to the laundry processing device, a first connection boss is disposed on the compartment body 1, and a second connection boss is disposed on the main component 2. The first connection boss is connected to the second connection boss. Lock screws pass through the first connection boss and the second connection boss to fasten the compartment body 1 and the main component 2 to the laundry processing device.

To ensure sealing between the compartment body 1 and the main component 2 and prevent the water flow from flowing outwards, raised ribs 15 cooperating with each other are disposed at the top of the compartment body 1 and the bottom of the main component 2. The raised ribs enclose and form sealing slots in the circumferential direction of the compartment body 1 and the main component 2. A sealing strip is mounted in the sealing slot to ensure that the compartment body 1 is sealed to the main component 2.

As shown in FIG. 6, FIG. 7, FIG. 8, and FIG. 9, the detergent compartment of this embodiment also includes a compartment cover assembly. The compartment cover assembly is mounted on the main component 1. The main component 1 and the compartment cover assembly enclose and form a water guide channel around the first receiving cavity 111, the second receiving cavity 22, and the third receiving cavity 23. The water guide channel can guide the water flow into the first receiving cavity 111, the second receiving cavity 22, and the third receiving cavity 23. A water guide part is disposed on the water guide channel and configured to guide the water in the water guide channel into the first receiving cavity 111, the second receiving cavity 22, and the third receiving cavity 23.

In the detergent compartment of this embodiment, the compartment body 1 and the main component 2 cooperate with each other and are fastened to each other such that the first receiving cavity 111, the second receiving cavity 22, and the third receiving cavity 23 for receiving the detergent are formed between the compartment body 1 and the main component 2. Correspondingly, the guide cavity and the drainage cavity 13 are provided. The guide cavity and the drainage cavity 13 can guide the diluted detergent into the laundry processing device. In this manner, multiple cavities can receive a large amount of detergents in a diversified manner, satisfying users' needs for placing different types of detergents.

Moreover, in the detergent compartment of this embodiment, a water guide channel is formed between the main component 1 and the compartment cover assembly. The water guide channel is disposed around the first receiving cavity 111, the second receiving cavity 22, and the third receiving cavity 23. A water guide part is disposed on the water guide channel and configured to guide the water flow into the corresponding receiving cavity. This can avoid water leakage. The water guide channel is disposed around the corresponding receiving cavity so that the water guide part can guide the water flow from the water guide channel to the inside of the first receiving cavity 111, the second receiving cavity 22, and the third receiving cavity 23 along the periphery of the first receiving cavity 111, the second receiving cavity 22, and the third receiving cavity 23. This method of water inflow along the periphery of the receiving cavity enables the water flow to rinse away the detergent in multiple directions so that the detergent can be rinsed away thoroughly and the detergent inside can be better diluted.

In this embodiment, the water guide part is disposed along the periphery of the first receiving cavity 111, the second receiving cavity 22, and the third receiving cavity 23 in one of the following manners: The water guide part is disposed along one edge of the first receiving cavity 111, one edge of the second receiving cavity 22, and one edge of the third receiving cavity 23; the water guide part is disposed along two opposite edges of the first receiving cavity 111, two opposite edges of the second receiving cavity 22, and two opposite edges of the third receiving cavity 23; or the water guide part is arranged around the first receiving cavity 111, around the second receiving cavity 22, and around the third receiving cavity 23.

In this embodiment, the compartment cover assembly includes a first compartment cover member 51 and a second compartment cover member 52 and is configured to be mounted and fastened to a table top 100. The first compartment cover member 51 is disposed below the table top 100. The second compartment cover member 52 is disposed above the table top 100.

The table top 100 has an opening area. A folded connecting edge is formed around the opening area. The first compartment cover member 51 is located below the folded connecting edge. The second compartment cover member 52 is located above the folded connecting edge. A screw is disposed on the second compartment cover member 52. The screw passes through a threaded hole of the first compartment cover member 51 at the bottom and a threaded hole on the folded connecting edge and then is fastened to the screw of the second compartment cover member 52 so that the three are fastened to each other.

Figure 10:
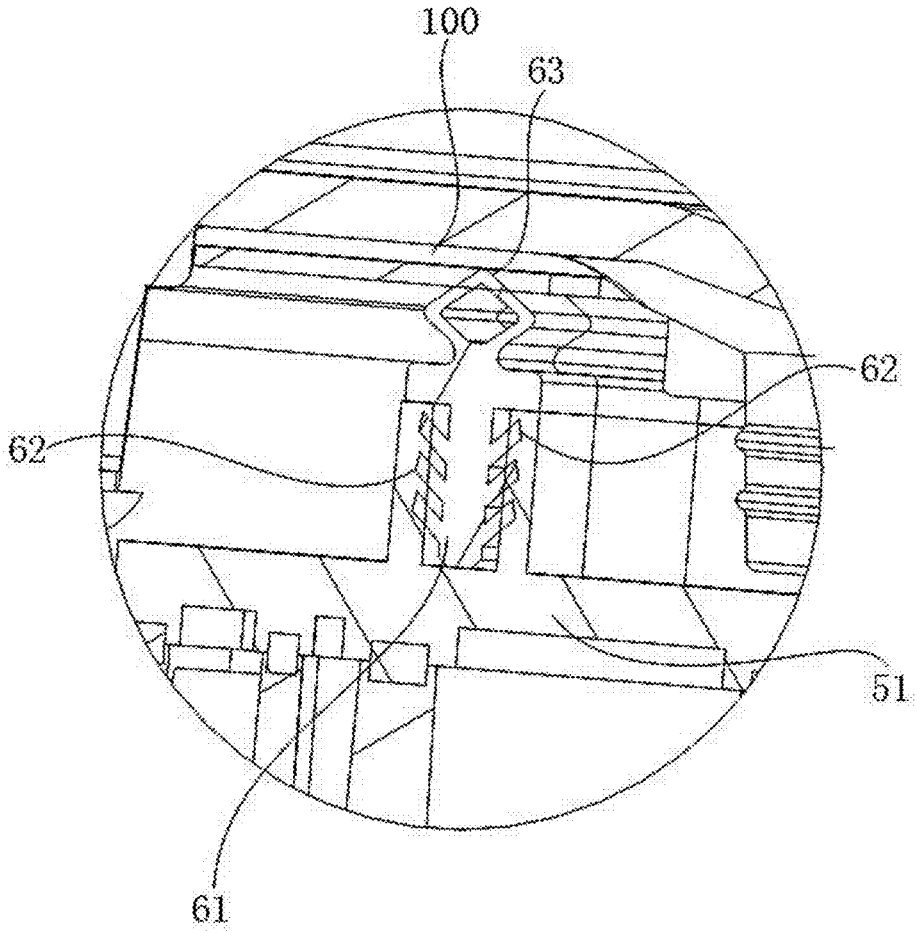
FIG. 10 is an enlarged view of A in FIG. 9.

As shown in FIG. 10, a sealing member is disposed between the first compartment cover member 51 and the table top 100 and in an annular insertion part formed on the first compartment cover member 51.

The sealing member includes a sealing body 61. The sealing body 61 is inserted into the annular insertion part. Abutment leg parts 62 protrude from the sealing body 61 and abut against the sidewall of the annular insertion part. The abutment leg parts 62 are abutment legs and are disposed on the sealing body 61 and inclined downwards, enabling secure sealing and fastening between the sealing member and the first compartment cover member 51. A deformation part 63 is disposed at the top of the sealing body 61. The deformation part 63 protrudes from the annular insertion part. The deformation part 63 has a hollow deformation cavity and can deform after being pressed to seal the table top 100 and the first compartment cover member 51.

The annular insertion part is an annular insertion groove in the circumferential direction of the first compartment cover member 51. The annular insertion groove has an annular opening facing the table top 100. The annular insertion groove includes an annular bottom wall and annular sidewalls on the two sides of the annular bottom wall. The annular opening faces the annular bottom wall. The sealing member is disposed between the first compartment cover member 51 and the table top 100. The sealing member is configured to be annular to cooperate with the annular insertion part.

The first compartment cover member 51 may be square or circular and may be made of plastic. The annular insertion part is integrally formed with the first compartment cover member 51.

To satisfy the sealing and installation requirements, the sealing member is made of rubber. The sealing member is integrally formed.

In this embodiment, the sealing body 61 includes a pressing part and a vertical part. The pressing part is disposed at the top of the vertical part. The vertical part is a vertical strip. The maximum width of the vertical part is less than the interval between the two annular sidewalls of the annular insertion groove so that the sealing body 61 can be quickly mounted into the annular insertion part. The pressing part is a pressing strip. The maximum width of the pressing part is greater than the maximum width of the vertical part and greater than the interval of the two annular sidewalls. The vertical part is inserted in the annular insertion groove. The pressing part plugs the ring opening between the two annular sidewalls to seal the ring opening.

Abutment leg parts 62 obliquely protrude from the two sides of the sealing body 61 and abut against the two sidewalls of the annular insertion groove after the sealing body 61 is inserted into the annular insertion part. The inclined abutment leg parts 62 abut against the inner sidewalls of the annular insertion groove after the abutment leg parts 62 are inserted into the annular insertion groove. This can effectively prevent the sealing member mounted to the first compartment cover member 51 from falling off from the first compartment cover member 51.

The angle between each abutment leg part 62 and the sealing body 61 is 45 degrees to 60 degrees.

The deformation cavity may be rhombic, rectangular, or oval. After being pressed, the deformation cavity can be pressed flat and has a larger area of contact with the table top 100.

For example, the deformation part 63 is disposed above the pressing part. Due to the deformation cavity formed inside the deformation part 63, when the table top 100 and the first compartment cover member 51 are mounted, the deformation part 63 between the table top 100 and the first compartment cover member 51 can be pressed through the table top 100.

Because the deformation cavity is hollow, when the table top 100 is mounted, the hollow deformation cavity can provide a compression space, making it easier to press the sealing member into the annular insertion groove of the first compartment cover member 51 during mounting.

Moreover, because the deformation cavity of this embodiment is hollow, when the deformation cavity is under the pressure of the table top 100, the deformation part 63 is flattened, that is, the deformation part 63 changes from a cube to a plane, increasing the area of the deformation part 63, thus increasing the area of contact between the table top 100 and the first compartment cover member 51, thus increasing the effect of sealing between the table top 100 and the first compartment cover member 51, thereby effectively preventing water vapor in the detergent compartment from running out of the table top 100.

Figure 11:
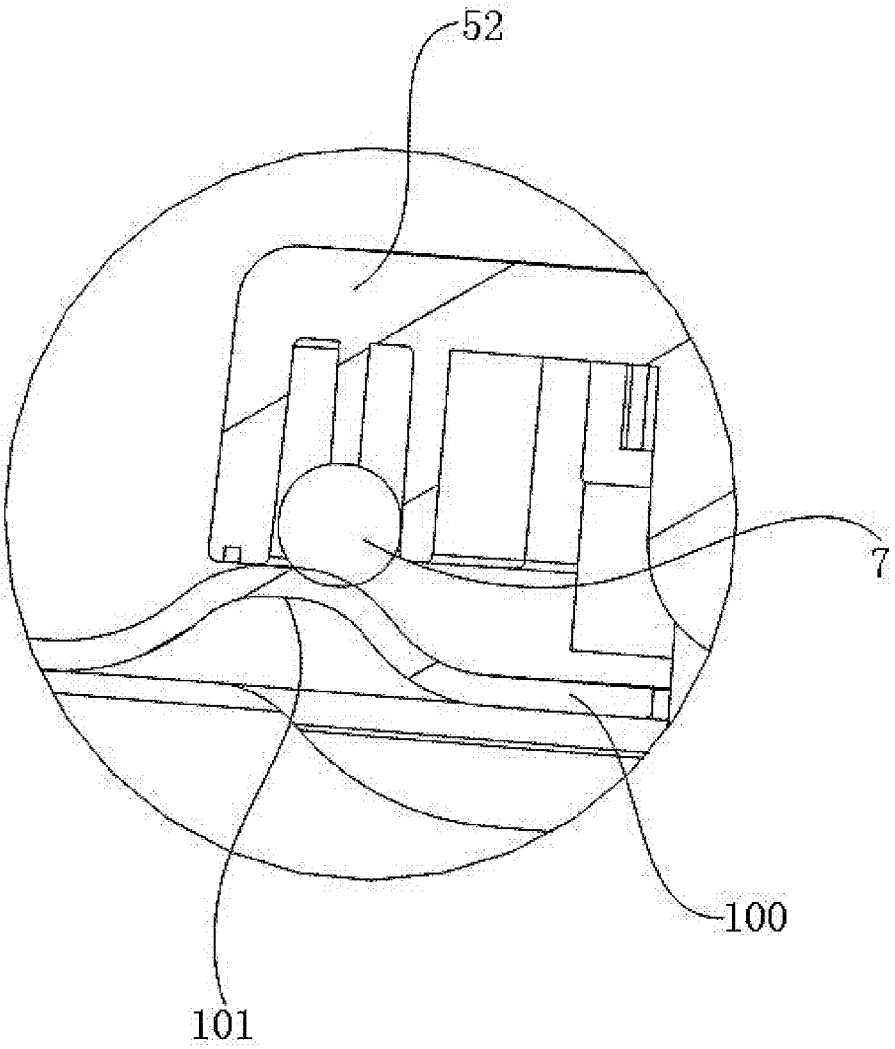
FIG. 11 is an enlarged view of B in FIG. 9.

As shown in FIG. 11, the second compartment cover member 52 is disposed above the table top 100. The second compartment cover member 52 includes a second compartment cover and a flip cover rotatably connected to the second compartment cover. A sealing structure is disposed between the second compartment cover and the table top 100.

A recessed cavity is formed at the top of the second compartment cover. A rotary shaft is disposed on the bottom wall of the recessed cavity. The flip cover is disposed in the recessed cavity and rotatably connected to the rotary shaft. It is feasible to open or close the placement port by flipping the cover.

The sealing structure includes an annular groove disposed around the second compartment cover. An annular sealing member 7 is inserted in the annular groove. The annular sealing member 7 is an annular sealing strip. An annular protrusion 101 is disposed on the table top 100. The annular protrusion 101 abuts against the bottom of the annular sealing member 7. After the table top 100 is fastened to the second compartment cover, the annular sealing member 7 on the second compartment cover is pressed and fastened by the annular protrusion 101 on the table top 100, thereby enabling a sealing connection between the second compartment cover and the table top 100.

A stop is disposed in the annular groove. The stop is arranged in the circumferential direction of the annular insertion groove. The height of the stop is less than the height of the sidewall of the annular groove. When the annular sealing member 7 is mounted in place, the stop abuts against the annular sealing member 7. The stop is a support protrusion disposed in the annular groove. The stop extends from the top wall of the annular groove to the annular mounting opening. The stop and the annular protrusion 101 face each other.

After being mounted into the annular groove, the annular sealing member 7 undergoes a downward abutment force of the stop in the annular groove and an abutment force of the annular protrusion 101 at the table top 100. The two forces are the same in size and opposite in direction. Under the action of the forces exerted by the stop and the annular protrusion 101, the annular sealing member 7 can be in secure contact with the table top 100 and the second compartment cover, ensuring a good sealing effect.

Figure 12:
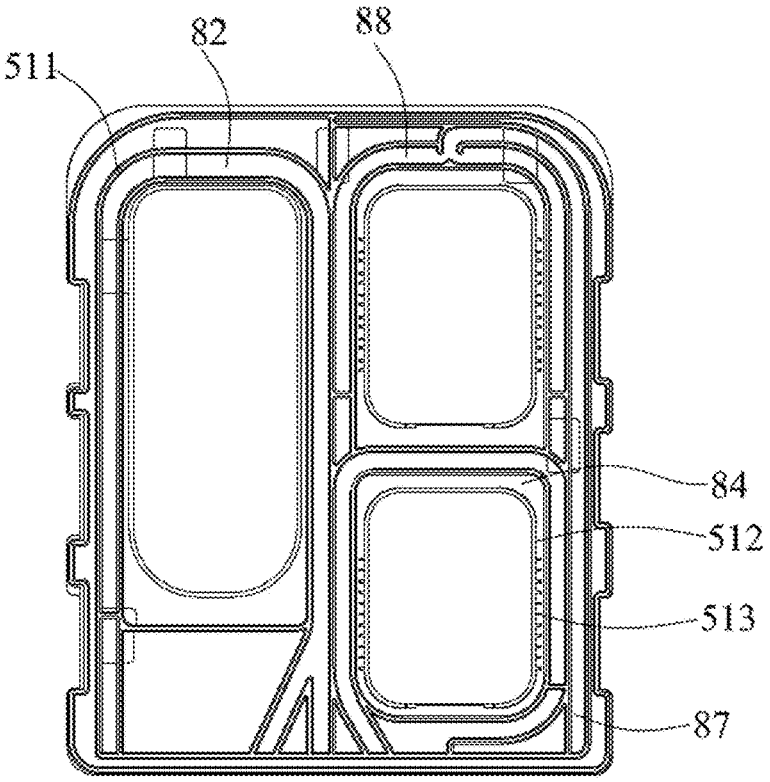
FIG. 12 is a view taken at the first angle to illustrate the structure of the first compartment cover member according to embodiment one of the present application.
Figure 13:
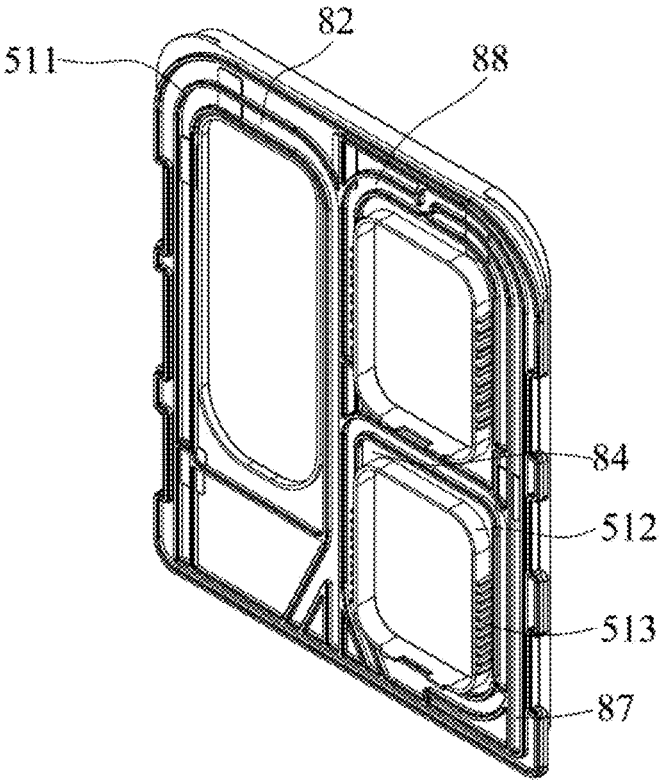
FIG. 13 is a view taken at the second angle to illustrate the structure of the first compartment cover member according to embodiment one of the present application.

As shown in FIG. 6, FIG. 12, and FIG. 13, the first compartment cover member 51 is fastened to the main component 2. A water guide channel is formed between the first compartment cover member 51 and the main component 2. In this embodiment, the water guide channel includes a first water guide channel disposed around the first receiving cavity 111, a second water guide channel disposed around the second receiving cavity 22, and a third water guide channel disposed around the third receiving cavity 23.

In this embodiment, a first flow channel 81 formed by first water guide ribs 27 is formed on the main component 2, and a first cooperative flow channel 82 formed by second water guide ribs 511 is disposed on the first compartment cover member 51. The first flow channel 81 and the first cooperative flow channel 82 are interconnected to form the first water guide channel.

For example, two first water guide ribs 27 are provided. The two first water guide ribs 27 protrude from the top wall of the main component 2 and are disposed around the first receiving cavity 111. The first flow channel 81 is formed between the two first water guide ribs 27. Moreover, two second water guide ribs 511 are provided. The two second water guide ribs 511 protrude downwards from the bottom of the first compartment cover member 51. The first cooperative flow channel 82 is formed between the two second water guide ribs 511. The first flow channel 81 and the first cooperative flow channel 82 have the same shape and can match each other completely.

The first flow channel 81 is disposed around the first receiving cavity 111. The water guide part is the water inlet 21. The water inlet 21 is disposed on the first flow channel 81, for example, the bottom wall of the first flow channel 81. The water inlet assembly 3 is disposed at the water inlet 21 and configured to pressurize the water flow passing through the water inlet 21 and direct the water flow onto the sidewall of the first receiving cavity 111.

In this embodiment, one water inlet 21 is provided. In other embodiments, multiple water inlets 21 may be provided. The multiple water inlets 21 are equally spaced on the bottom wall of the first flow channel 81. At each water inlet 21, there is a water inlet assembly 3 for enabling the water flow to rapidly enter the first receiving cavity 111 and rinse away the detergent on the sidewall of the first receiving cavity 111, thereby improving the utilization rate of the detergent.

In this embodiment, a second flow channel 83 formed by third water guide ribs 28 is formed on the main component 2, and a second cooperative flow channel 84 formed by fourth water guide ribs 512 is disposed on the first compartment cover member 51. The second flow channel 83 and the second cooperative flow channel 84 are interconnected to form the second water guide channel.

For example, two third water guide ribs 28 are provided. Each of the two third water guide ribs 28 protrudes from the top wall of the main component 2. The two third water guide ribs 28 are disposed around the second receiving cavity 22. The second flow channel 83 is formed between the two third water guide ribs 28. Moreover, two fourth water guide ribs 512 are provided. The two fourth water guide ribs 512 protrude downwards from the bottom of the first compartment cover member 51. The second cooperative flow channel 84 is formed between the two fourth water guide ribs 512. The second flow channel 83 and the second cooperative flow channel 84 have the same shape and can match each other completely.

A water guide part is disposed on the sidewall of the second channel 83 facing the second receiving cavity 22. The water guide part is a first water inlet notch 831. Multiple first water inlet notches 831 may be provided. The multiple first water inlet notches 831 are equally spaced from each other.

It is feasible to provide first water inlet notches 831 on the two opposite sidewalls of the second flow channel 83 to enable the water flow to rapidly enter the second receiving cavity 22.

The second flow channel 83 has a drain hole 832 that runs through the bottom wall of the second flow channel 83. The drain hole 832 is connected to the second flow channel 83 and the guide cavity, facilitating rapid drainage of the water flow from the second flow channel 83 and preventing storage of water in the second flow channel 83. The drain hole 832 is away from the water inlet of the second flow channel 83.

To guide the water flow in the second water guide channel, a water guide rib plate group 513 is disposed on the sidewall of the fourth water guide rib 512. Each group includes two water guide rib plates. The two water guide rib plates face the first water inlet notch 831 to guide water from the second water guide channel to the first water inlet notch 831.

In this embodiment, a third flow channel 85 is formed on the main component 2. The third flow channel 85 extends along an edge of the second receiving cavity 22 to an edge of the third receiving cavity 23. The third flow channel 85 has an outlet 851. The third flow channel 85 is formed by being enclosed by two fifth water guide ribs 29 and the main component 2 at the fifth water guide ribs 29. Each fifth water guide rib 29 extends along an edge of the second receiving cavity 22 to an edge of the third receiving cavity 23.

Two fourth flow channels 86 are formed on the main component 2 and arranged on two sides of the third receiving cavity 23 respectively. Each fourth flow channel 86 includes an inlet. The inlet is connected to the outlet 851. At least one of the fourth flow channels 86 has a water guide part connected to the third receiving cavity 23.

The water guide part is a second water inlet notch 861. Multiple second water inlet notches 861 may be provided. The multiple second water inlet notches 861 are equally spaced along the length direction of the third receiving cavity 23.

A third cooperative flow channel 87 connected to the third flow channel 85 and a fourth cooperative flow channel 88 connected to the fourth flow channel 86 are disposed on the first compartment cover member 51. The third cooperative flow channel 87 and the third flow channel 85 are connected to each other to form a first connection flow channel. The fourth cooperative flow channel 88 and the fourth flow channel 86 are connected to each other to form a second connection flow channel. The first connection flow channel and the second connection flow channel form the third water guide channel.

When entering the detergent compartment, the water flow enters the first connection flow channel, passes through the outlet 851, enters the second connection flow channel on the two sides of the third receiving cavity 23, and then flows into the third receiving cavity 23 through the second water inlet notch 861 on the second connection flow channel to dilute the detergent.

For example, a sixth water guide rib 210 is disposed around the third receiving cavity 23, and one of the fourth flow channels 86 is formed between the inner fifth water guide rib 29 and the sixth water guide rib 210.

A seventh water guide rib 211 is arranged to be opposite to the fifth water guide rib 29 and is located on the other side of the third receiving cavity 23. The other fourth flow channel 86 is formed between the seventh water guide rib 211 and the sixth water guide rib 210.

The third cooperative flow channel 87 and the fourth cooperative flow channel 88 on the first compartment cover member 51 are also formed by raised ribs. The raised ribs on the first compartment cover member 51 and the raised ribs on the main component 2 are arranged in the same manner for matching between each other.

A water diverter protrusion 212 is disposed on the sixth water guide rib 210. The water diverter protrusion 212 is arranged to be opposite to the outlet 851 and configured to divert the water flow in the third flow channel 85 into the two fourth flow channels 86.

The first water guide channel, the second water guide channel, and the third water guide channel each have a water outlet into which a pipe can be inserted so that the water flow can be carried to a corresponding water guide channel.

In some embodiments of the present application, four inlet pipes are provided. The four inlet pipes are a first inlet pipe 91, a second inlet pipe 92, a third inlet pipe 93, and a fourth inlet pipe 94. The first inlet pipe 91 and the second inlet pipe 92 are inserted in the water inlet of the first water guide channel. The third inlet pipe 93 is inserted in the water inlet of the second water guide channel. The fourth inlet pipe 94 is inserted in the water inlet of the third water guide channel.

The multiple water guide channels are connected to different inlet pipes so that hot water or cold water can enter a respective cavity according to the detergent requirements of the cavity, thereby satisfying the dissolution requirements of different detergents and improving the washing effect of the laundry processing device.

This embodiment also provides a laundry processing device. The laundry processing device includes a drum and the detergent compartment. The laundry processing device of this embodiment is an industrial laundry processing device or a household laundry processing device.

Embodiment Two

Figure 14:
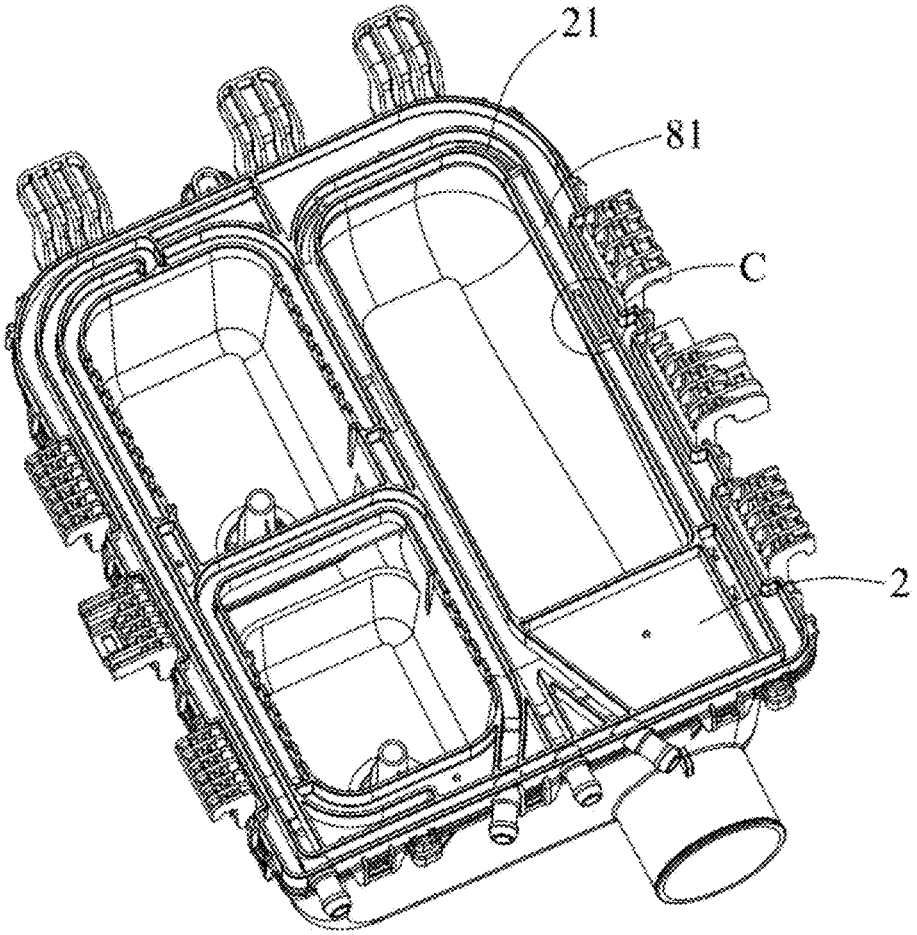
FIG. 14 is a view illustrating the structure of the compartment body and the main component according to embodiment two of the present application.
Figure 15:
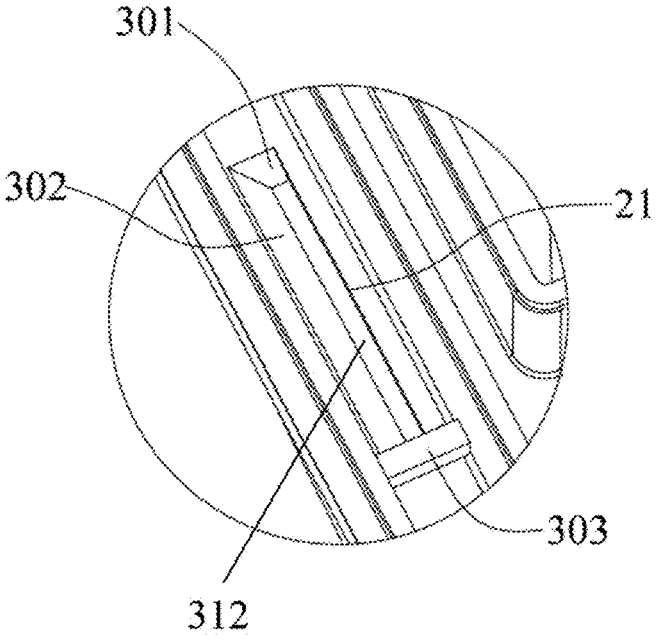
FIG. 15 is an enlarged view of C in FIG. 14.

As shown in FIGS. 14 and 15, this embodiment provides a detergent compartment. Compared with the detergent compartment of embodiment one, the water inlet assembly 3 of the detergent compartment in this embodiment includes a guide plate 301 disposed along the circumferential direction of the water inlet 21 and extending into the first receiving cavity 111, a guide surface 302 inclined towards the bottom of the first receiving cavity 111 and extending towards the sidewall of the first receiving cavity 111 is provided on a side of the guide plate 301 facing the sidewall of the first receiving cavity 111, and a second long flow channel 312 is formed between the guide surface 302 and the guide plate 301 facing the guide surface 302.

After entering the first flow channel 81, the water flow passes through the water inlet 21, flows downwards along the guide surface 302, and flows out of the second long flow channel 312 under the action of the guide plate 301. This increases the water inflow pressure, facilitating rapid rinsing of the detergent in the first receiving cavity 111. Moreover, the water flow can rinse the sidewall of the first receiving cavity 111 to thoroughly rinse away the detergent adhering to the sidewall of the first receiving cavity 111, improving the utilization rate of the detergent and preventing the detergent from being left on the sidewall of the first receiving cavity 111. Moreover, the second long flow channel 312 increases the water outflow pressure and enlarges the water outflow area, thereby increasing the area of water rinsing the sidewall of the first receiving cavity 111.

In this embodiment, multiple water inlets 21 may be disposed in the first flow channel 81. At each water inlet 21, the water inlet assembly 3 of this embodiment is provided, ensuring that all parts of the sidewall of the first receiving cavity 111 can be rinsed.

In this embodiment, four water inlets 21 are provided. The first flow channel 81 is disposed around the first receiving cavity 111. Therefore, it is feasible to dispose the two water inlets 21 on the two opposite straight channels of the first flow channel 81 and dispose the other two water inlets 21 on the two corners of the first flow channel 81, ensuring that all parts of the sidewall of the first receiving cavity 111 can be rinsed.

In this embodiment, the angle between the guide surface 302 and the horizontal plane is 45 degrees to 60 degrees, maximizing the water inflow pressure without affecting the water inflow speed. The length of each water inlet 21 is 15 mm to 35 mm, improving the effect of rinsing the sidewall of the first receiving cavity 111.

A water blocking protrusion 303 is disposed on a side of the water inlet 21 facing the direction of the water flow.

The water blocking protrusion 303 can block the water flow about to enter the water inlet 21, reduce the speed of the water flow, prevent the water flow from flowing rapidly from the water outlet to the first receiving cavity 111, and ensure that the water flow can flow downwards through the water inlet 21.

Other structures of the detergent compartment of this embodiment are the same as those of embodiment one.

This embodiment also provides a laundry processing device. The laundry processing device includes a drum and the detergent compartment of the previous embodiment. The laundry processing device of this embodiment is an industrial laundry processing device or a household laundry processing device.

Embodiment Three

This embodiment provides a detergent compartment. Compared with the detergent compartment of embodiment one and the detergent compartment of embodiment two, the first flow channel 81 has multiple water inlets 21. At each water inlet 21, a water inlet assembly 3 is provided. Among the water inlet assemblies 3, some have the same structure as the water inlet assembly 3 of embodiment one, and some have the same structure as the water inlet assembly 3 of embodiment two. The two types of water inlet assemblies 3 cooperate with each other to improve the effect of rinsing the sidewall of the first receiving cavity 111.

Illustratively, the first flow channel 81 is disposed around the first receiving cavity 111, and water inlets 21 are disposed on two opposite vertical straight channels of the first flow channel 81. The water inlet assemblies 3 at these water inlets 21 may have the same structure as the water inlet assembly 3 of embodiment two. A water inlet 21 is disposed in the middle of a cross straight channel connecting two vertical straight channels, and the water inlet assembly 3 at this water inlet 21 may have the same structure as the water inlet assembly 3 of embodiment one. In this manner, the three sidewalls of the first receiving cavity 111 can be rinsed.

Other structures of the detergent compartment of this embodiment are the same as those of embodiment one.

This embodiment also provides a laundry processing device. The laundry processing device includes a drum and the detergent compartment of the previous embodiment. The laundry processing device of this embodiment is an industrial laundry processing device or a household laundry processing device.

What is claimed is:

1. A detergent compartment, comprising:

a first receiving cavity, wherein a top of the first receiving cavity is provided with at least one water inlet, and a water inlet assembly disposed at a water inlet among the at least one water inlet, the water inlet assembly configured to pressurize a water flow passing through the water inlet and to direct the water flow onto a sidewall of the first receiving cavity;

wherein the water inlet assembly comprises:

an inlet pipe disposed in the first receiving cavity, wherein a first end of the inlet pipe is connected to the water inlet; and a pressurizing plate configured to receive the water flow from the inlet pipe, wherein a first end of the pressurizing plate is connected to a second end of the inlet pipe, a second end of the pressurizing plate is inclined towards a bottom of the first receiving cavity and extends towards the sidewall of the first receiving cavity, and a first long flow channel is formed between the pressurizing plate and the sidewall of the first receiving cavity.

2. The detergent compartment of claim 1, wherein the pressurizing plate is L-shaped, a riser plate of the pressurizing plate is connected to the inlet pipe, an arc notch extending downwards and towards a cross plate of the pressurizing plate is disposed on the riser plate of the pressurizing plate, and a slope inclined downwards is disposed on an upper surface of the cross plate of the pressurizing plate.

3. The detergent compartment of claim 1, wherein the water inlet assembly further comprises a water blocking member, the water blocking member is connected to the pressurizing plate, and the water blocking member is configured to block the water flow from flowing away from the sidewall of the first receiving cavity.

4. The detergent compartment of claim 3, wherein the water blocking member is an L-shaped plate and is disposed on a side of the pressurizing plate facing away from the sidewall of the first receiving cavity, a riser plate of the water blocking member is connected to the first end of the pressurizing plate, and a cross plate of the water blocking member is connected to the second end of the pressurizing plate.

5. The detergent compartment of claim 1, further comprising:

a compartment body; and a main component connected to the compartment body, wherein the main component and the compartment body form the first receiving cavity, and the at least one water inlet is disposed on the main component.

6. The detergent compartment of claim 5, wherein a first flow channel is disposed around the first receiving cavity and on the main component, and the at least one water inlet is disposed in the first flow channel.

7. A detergent compartment, comprising:

a first receiving cavity, wherein a top of the first receiving cavity is provided with at least one water inlet, and a water inlet assembly disposed at a water inlet among the at least one water inlet, the water inlet assembly configured to pressurize a water flow passing through the water inlet and to direct the water flow onto a sidewall of the first receiving cavity;

wherein the water inlet assembly comprises a guide plate disposed along a circumferential direction of the water inlet and extending into the first receiving cavity, a guide surface inclined towards a bottom of the first receiving cavity and extending towards the sidewall of the first receiving cavity is provided at a part of the guide plate facing the sidewall of the first receiving cavity, and a second long flow channel is formed between the guide surface and a part of the guide plate facing the guide surface.

8. The detergent compartment of claim 7, wherein a water blocking protrusion is disposed on a side of the water inlet facing the guide plate.

9. A laundry processing device, comprising:

a drum and a detergent compartment, wherein the detergent compartment comprises a first receiving cavity, a top of the first receiving cavity is provided with at least one water inlet, and a water inlet assembly disposed at a water inlet among the at least one water inlet, the water inlet assembly configured to pressurize a water flow passing through the water inlet and to direct the water flow onto a sidewall of the first receiving cavity;

wherein the water inlet assembly comprises:

an inlet pipe disposed in the first receiving cavity, wherein a first end of the inlet pipe is connected to the water inlet; and a pressurizing plate configured to receive the water flow from the inlet pipe, wherein a first end of the pressurizing plate is connected to a second end of the inlet pipe, a second end of the pressurizing plate is inclined towards a bottom of the first receiving cavity and extends towards the sidewall of the first receiving cavity, and a first long flow channel is formed between the pressurizing plate and the sidewall of the first receiving cavity.

10. The laundry processing device of claim 9, wherein the pressurizing plate is L-shaped, a riser plate of the pressurizing plate is connected to the inlet pipe, an arc notch extending downwards and towards a cross plate of the pressurizing plate is disposed on the riser plate of the pressurizing plate, and a slope inclined downwards is disposed on an upper surface of the cross plate of the pressurizing plate.

11. The laundry processing device of claim 9, wherein the water inlet assembly further comprises a water blocking member, the water blocking member is connected to the pressurizing plate, and the water blocking member is configured to block the water flow from flowing away from the sidewall of the first receiving cavity.

12. The laundry processing device of claim 11, wherein the water blocking member is an L-shaped plate and is disposed on a side of the pressurizing plate facing away from the sidewall of the first receiving cavity, a riser plate of the water blocking member is connected to the first end of the pressurizing plate, and a cross plate of the water blocking member is connected to the second end of the pressurizing plate.

13. The laundry processing device of claim 9, wherein the water inlet assembly comprises a guide plate disposed along a circumferential direction of the water inlet and extending into the first receiving cavity, a guide surface inclined towards a bottom of the first receiving cavity and extending towards the sidewall of the first receiving cavity is provided at a part of the guide plate facing the sidewall of the first receiving cavity, and a second long flow channel is formed between the guide surface and a part of the guide plate facing the guide surface.

14. The laundry processing device of claim 13, wherein a water blocking protrusion is disposed on a side of the water inlet facing the guide plate.

15. The laundry processing device of claim 9, further comprising:

a compartment body; and a main component connected to the compartment body, wherein the main component and the compartment body form the first receiving cavity, and the at least one water inlet is disposed on the main component.

16. The laundry processing device of claim 15, wherein a first flow channel is disposed around the first receiving cavity and on the main component, and the at least one water inlet is disposed in the first flow channel.

* * * * *